US008366453B2

(12) United States Patent
Chang et al.

(10) Patent No.: US 8,366,453 B2
(45) Date of Patent: Feb. 5, 2013

(54) CONTACT TERMINAL HAVING FOOTHOLD ARRANGEMENT CAPABLE OF INTERLOCKING VIA OF PRINTED CIRCUIT BOARD

(75) Inventors: Yen-Chih Chang, Tu-Cheng (TW); Ke-Hao Chen, Tu-Cheng (TW); Jia-Hau Liu, Tu-Cheng (TW)

(73) Assignee: Hon Hai Precision Ind. Co., Ltd., New Taiwan (TW)

( * ) Notice: Subject to any disclaimer, the term of this patent is extended or adjusted under 35 U.S.C. 154(b) by 162 days.

(21) Appl. No.: 12/944,756

(22) Filed: Nov. 12, 2010

(65) Prior Publication Data

US 2011/0111607 A1 May 12, 2011

(30) Foreign Application Priority Data

Nov. 12, 2009 (TW) ..... 98220962 U

(51) Int. Cl.
*H01R 12/00* (2006.01)

(52) U.S. Cl. ..... 439/70; 439/66

(58) Field of Classification Search ..... 439/70, 439/66, 82, 862

See application file for complete search history.

(56) References Cited

U.S. PATENT DOCUMENTS 6,921,271 B2 7/2005 Liao et al.
7,008,237 B1 * 3/2006 Ma et al. ..... 439/66
7,052,284 B2 * 5/2006 Liao et al. ..... 439/66
7,198,493 B2 * 4/2007 Chen et al. ..... 439/66
7,775,805 B2 * 8/2010 Liao et al. ..... 439/66
7,862,343 B1 * 1/2011 Lin et al. ..... 439/66
7,878,818 B2 * 2/2011 Cheng et al. ..... 439/66
7,950,928 B2 * 5/2011 Szu ..... 439/70
2009/0269950 A1 * 10/2009 Liao et al. ..... 439/66
2010/0055944 A1 * 3/2010 Chang et al. ..... 439/78
2011/0032681 A1 * 2/2011 Chang et al. ..... 361/747

* cited by examiner

*Primary Examiner* — Hae Moon Hyeon

(74) *Attorney, Agent, or Firm* — Wei Te Chung; Ming Chieh Chang

(57) ABSTRACT

An electrical contact used in an electrical connector adapted for electrically connecting with an integrated circuit (IC) package and a printed circuit board is provided. Each contact comprises a base section, an upper resilient arm and a lower elastic arm extending from two opposite ends of the base section, respectively. The electrical connector comprises an insulative housing and a plurality of contacts retained in the insulative housing. The insulative housing includes a mating surface, a mounting surface, and a plurality of contact passageways passing through the mating surface and the mounting surface. The lower elastic arm of the contact at least partially projects below the mounting surface of the insulative housing. The lower elastic arm includes a first resisting portion for guiding the contact to be inserted into a via of the printed circuit board and resisting against inner wall of the via of the printed circuit board.

20 Claims, 5 Drawing Sheets

CONTACT TERMINAL HAVING FOOTHOLD ARRANGEMENT CAPABLE OF INTERLOCKING VIA OF PRINTED CIRCUIT BOARD

BACKGROUND OF THE INVENTION

1. Field of the Invention

The present invention relates to a contact terminal, and more particularly to a contact terminal having a foothold arrangement which can properly interlock with a via of a printed circuit board. The present invention also relates to a connector using the same.

2. Description of Prior Art

Land grid array (LGA) sockets are widely used in various electrical devices to establish electrical connection between a land grid array package and a circuit substrate. Basically, a land grid array socket includes an insulative housing defining a number of passageways and a number of conductive terminals resided in corresponding passageways, respectively. Each conductive terminal includes a resilient arm sticking out of the housing to mate with a grid array package. In use, under compression of the land grid array package, the resilient arm is deflected from its natural position and elastically abuts against the land grid array package thereby forming electrical engagement between the land grid array package and the conductive terminal.

U.S. Pat. No. 6,921,271 issued to Liao, et al. on Jul. 26, 2005 discloses a socket, for electrically connecting a package and a printed circuit board, including a dielectric housing and a plurality of conductive terminals secured in the housing. The housing defines upper and lower surfaces and a number of cells. Each terminal has a retention body secured in a corresponding cell defined on the housing. The retention body has an upper end projecting beyond the upper mating surface and a lower end projecting beyond the lower surface. Upper and lower protrusions extend from the upper and lower mating surfaces of the housing respectively, for supporting the package and abutting against the printed circuit board, respectively.

However, in the existing so called LGA contact terminal, the tail portion of each contact terminal is disposed between an upper surface of the printed circuit board, and a bottom surface of a socket connector. As a result, there is always a gab therebetween such that it is unlikely to reduce the overall height of the socket. On the other hand, in order to have the contact terminal be securely secured within the socket, each contact terminal has to have a certain holdup within the socket such that the thickness of the socket has to be remained to a certain range. If the socket is too thin, then its housing could be broken apart when the contact terminal is inserted. Accordingly, it would be preferably to keep the socket within the certain range, while its overall height can be reduced.

Hence, an improved electrical contact for being used in an electrical connector is required to overcome the disadvantages of the prior art.

SUMMARY OF THE INVENTION

An object of the present invention is to provide an electrical contact used in an electrical connector, and the electrical contact has an elastic arm with a curved resisting portion for guiding the contact when inserted into a via of a printed circuit board when the electrical connector is assembled on the printed circuit board.

To fulfill the above-mentioned object, each contact comprises a base section, an upper resilient arm and a lower elastic arm extending from two opposite ends of the base section, respectively. The electrical connector comprises an insulative housing and a plurality of contacts retained in the insulative housing. The insulative housing includes a mating surface, a mounting surface, and a plurality of contact passageways passing through the mating surface and the mounting surface. The lower elastic arm of the contact at least partially projects below the mounting surface of the insulative housing. The lower elastic arm includes a first resisting portion for guiding the contact to be inserted into a via of the printed circuit board and resisting against inner wall of the via of the printed circuit board.

Other features and advantages of the invention will become more apparent from the following detailed description of the present embodiment when taken in conjunction with the accompanying drawings.

DETAILED DESCRIPTION OF THE INVENTION

Figure 1:
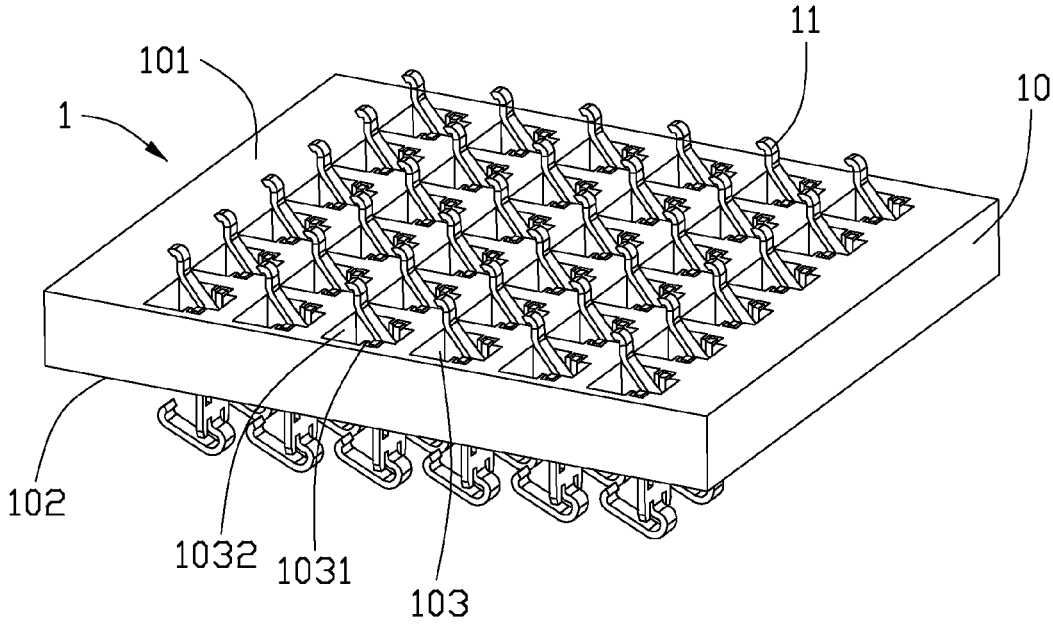
FIG. 1 is an assembled, perspective view of an electrical connector according to a preferred embodiment of the present invention.

Reference will now be made to the drawing figures to describe the present invention in detail.

Referring to FIG. 1 to FIG. 5, an LGA electrical connector 1 used for electrically connecting an integrated circuit (IC) package (not shown) and a printed circuit board 2 according to the preferred embodiment of the present invention is shown. The electrical connector 1 comprises an insulative housing 10 and a plurality of contacts 11 received in the insulative housing 10.

As shown in FIG. 1, the insulative housing 10 includes a mating surface 101 adapted to face the IC package (not shown) and a mounting surface 102 adapted to face the printed circuit board 2. The insulative housing 10 defines a plurality of contact passageways 103 extending throughout the mating surface 101 and the mounting surface 102. Each contact passageway 103 includes a narrow retaining slot 1031 and a wide receiving slot 1032 in communication with each other.

Figure 2:
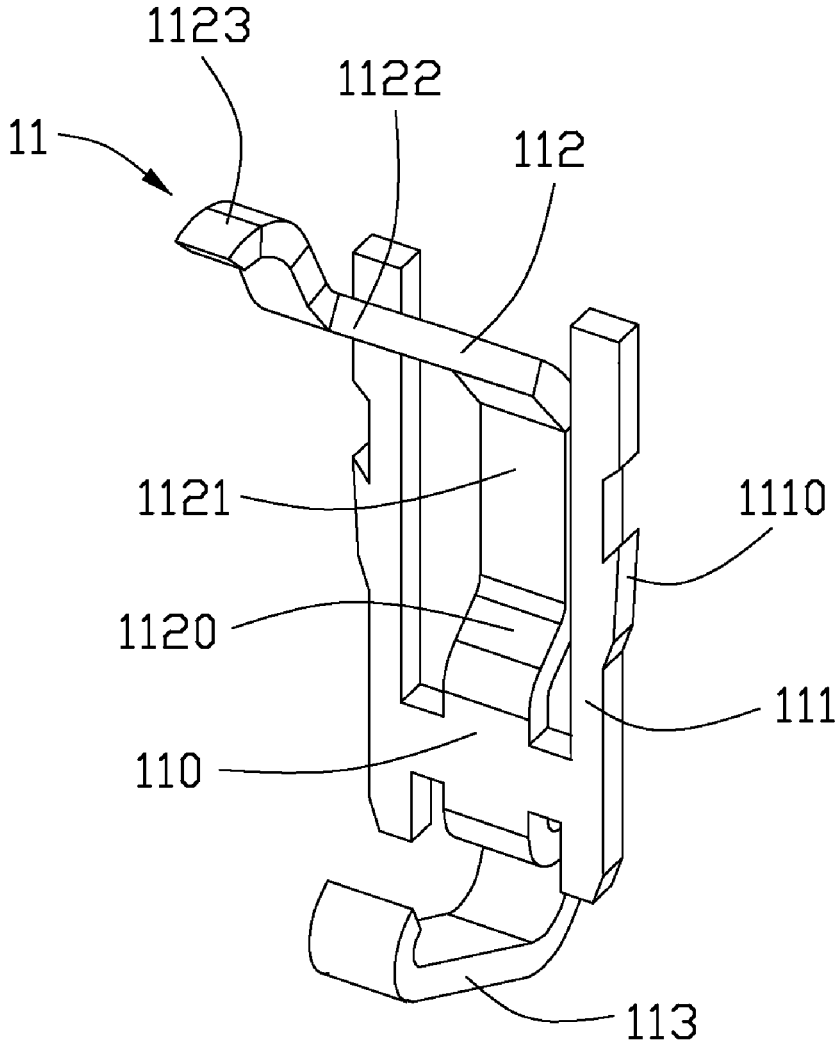
FIG. 2 is a perspective view of a contact of the electrical connector in FIG. 1.

Conjoined with FIG. 2, the contact 11 comprises a base section 110 defining a principal plane and an upper resilient arm 112 extending upwardly from an upper end of the base section 110. A pair of opposite locating members 111 stretches out from two lateral sides of the base section 110 for being vertically retained in the narrow retaining slot 1031 of the contact passageway 103 of the insulative housing 10. A pair of barbs 1110 is formed at middle of an outer edge of the locating member 111 for being vertically retained in the narrow retaining slot 1031 of the insulative housing 10 by interference fitting.

The upper resilient arm 112 includes a main beam 1121 linking with the base section 110 by a curved connecting portion 1120 which extends upwardly and obliquely from the upper end of the base section 110. The main beam 1121 extends upwardly at a vertical direction from a distal end of the connection portion 1120. The connecting portion 1120 and the main beam 1121 both are positioned between the pair of the locating members 111. A beam contact portion 1122 extends upwardly and obliquely from the upper end of the main beam 1121. The beam contact portion 1122 forms an arched contacting section 1123 at a distal end thereof for electrically connecting with the IC package (not shown). The beam contacting portion 1122 projects above the mating surface 101 of the insulative housing 10.

The contact 11 further comprises a curved lower elastic arm or tail portion 113 extending from a bottom end of the base section 110. The lower elastic arm 113 projects below the mounting surface 102 of the insulative housing 10. The printed circuit board 2 defines a plurality of vias 20 corresponding to the contact passageways 103. When the electrical connector 1 is assembled on the printed circuit board 2, the lower elastic arm 113 of each contact 11 can be further received in the via 20 of the printed circuit board 2. The lower elastic arm 113 includes a C-shaped first resisting portion 1131 connecting with the lower end of the base section 110 and a second resisting portion 1132 extending upwardly and obliquely from the lower end of the first resisting portion 1131. The second resisting portion 1132 includes an arched end to avoid scrapping the inner wall of the via 20 of the printed circuit board 2. Both the first resisting portion 1131 and the second resisting portion 1132 can abut against the inner wall of the via 20 of the printed circuit board 2, since the inner wall of the via 20 is formed with a clad layer, the contact 11 electrically contact with the printed circuit board 2.

Figure 3:
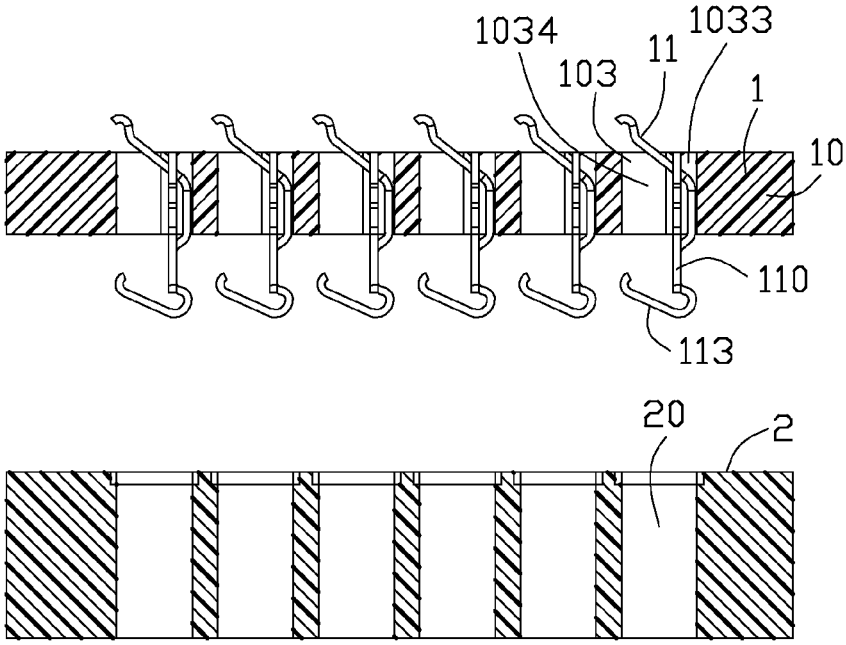
FIG. 3 is a sectional view of the electrical connector and a printed circuit board before assembly together.
Figure 4:
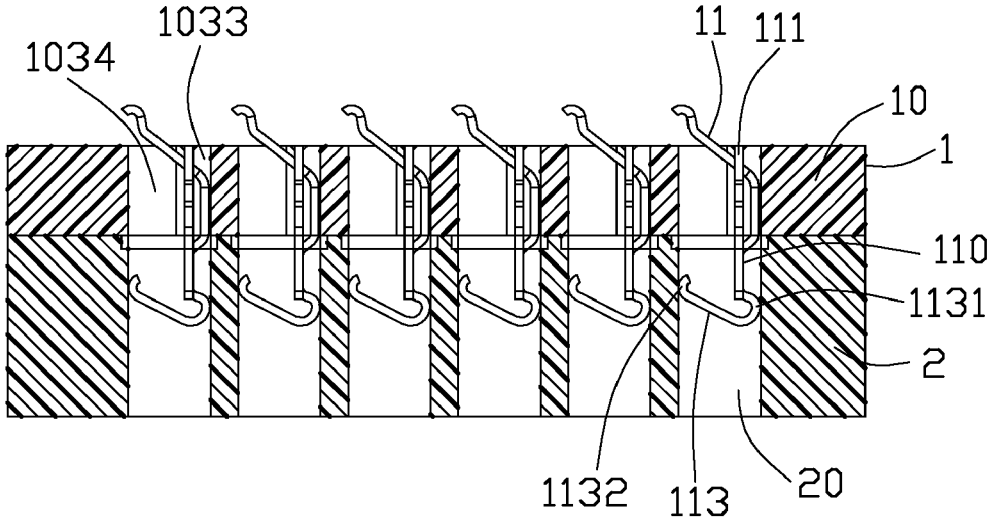
FIG. 4 is another sectional view of the electrical connector assembled on the printed circuit board.
Figure 5:
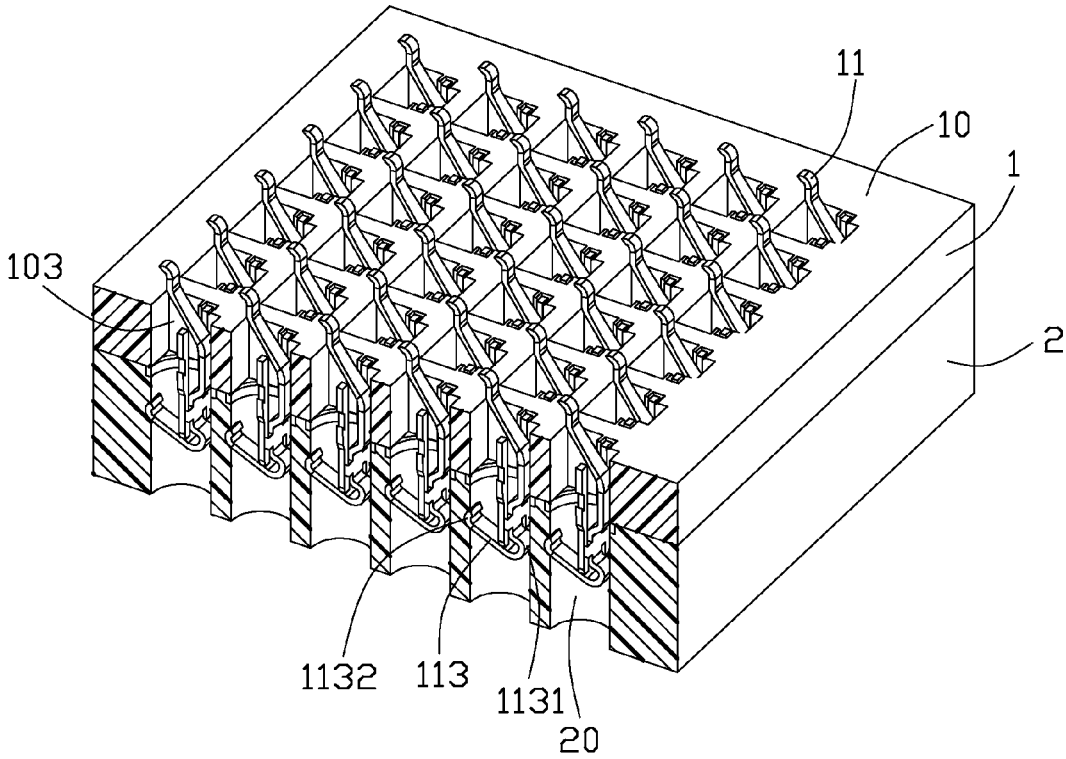
FIG. 5 is a partially cutaway view of the electrical connector and the printed circuit board illustrated in FIG. 4.

Referring to FIG. 3, to FIG. 5, in assembly, the contact 11 is inserted in the contact passageway 103 of the insualtive housing 10, the locating members 111 of the contact 11 are positioned in the narrow retaining slot 1031, with the barbs 1110 thereof interferingly engaging with side walls of the narrow retaining slot 1031. The passageway 103 is divided into opposite first and second spaces 1033, 1034 by two sides of said locating members 111 in a transverse direction perpendicular to a vertical plane defined by said locating members 111. The upper resilient arm 112 firstly extends toward the first space 1033 with a segment transversely abutting against an interior face of the insulative housing 10 around said corresponding passageway 103, and further backwardly extend toward the second space 1034 and above a top face of the insulative housing 10. The upper resilient arm 112 sticks upwardly and obliquely with respect to the mating surface 101 of the insulative housing 10 to electrically mate with the IC package (not shown) placed thereon. The lower elastic arm 113 extends downward from said lower portion of the retention section firstly toward a space under said first space 1033 and successively backwardly toward another space under said second space 1034. The base section 110 and the lower elastic arm 113 of the contact 11 are both exposed from the mounting surface 102 of the insulative housing 10.

When the electrical connector 1 is assembled on the printed circuit board 2, the base section 110 and the lower elastic arm 113 of the contact 11 can be easily inserted into the via 20 of the printed circuit board 2, because the C-shaped first resisting portion 1131 can play a guiding function in assembling process. Finally, the first resisting portion 1131 and the second resisting portion 1132 can respectively resist on the inner wall of the via 20 of the printed circuit board 2, for creating double interference with the clad layer of the inner wall of the via 20 thereby ensuring a reliable electrical connection between the printed circuit board 2 and the contact 11. Additionally, it can reduce a height of the electrical connector 1 for the contact 11 partially received in the printed circuit board 2. Thus, the electrical connector 1 can save room occupied by the electrical connector 1 and satisfy a smaller trend of the electrical connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for electrically connecting with an integrated circuit (IC) package and a printed circuit board, comprising:

an insulative housing;

a plurality of contacts positioned in the insulative housing, each contact comprising a base section, an upper resilient arm and a lower elastic arm extending from two opposite ends of the base section, respectively; wherein the lower elastic arm of the contact at least partially projects below the mounting surface of the insulative housing, and the lower elastic arm includes a first resisting portion inserted into a via of the printed circuit board and resisting against an inner wall of the via of the printed circuit board.

2. The electrical connector as claimed in claim 1, wherein the insulative housing comprises a mating surface, a mounting surface opposite to the mating surface, and a plurality of contact passageways passing through the mating surface and the mounting surface for receiving the contacts, each contact passageway of the insulative housing includes a narrow retaining slot and a wide receiving slot in communication with each other.

3. The electrical connector as claimed in claim 2, wherein a pair of opposite locating members stretches out from two lateral sides of the base section to vertically retain the contact in the narrow retaining slot of the contact passageway of the insulative housing.

4. The electrical connector as claimed in claim 3, wherein a pair of barbs is further formed at middle of an outer edge of the locating members for interfering with the retaining slot of the contact passageway of the insulative housing.

5. The electrical connector as claimed in claim 4, wherein the upper resilient arm includes a main beam linking with the base section by a curved connecting portion and a beam contact portion extending upwardly and obliquely from the upper end of the main beam.

6. The electrical connector as claimed in claim 5, wherein the connecting portion extends upwardly and obliquely from the upper end of the base section and the main beam extends upwardly at a vertical direction from a distal end of the connection portion.

7. The electrical connector as claimed in claim 6, wherein the base section and the lower elastic arm of the contact both project below the mounting surface of the insulative housing and can be received in the via of the printed circuit board.

8. The electrical connector as claimed in claim 7, wherein the first resisting portion has a C-shaped configuration, and a second resisting portion extends upwardly and obliquely from a free end of the first resisting portion.

9. The electrical connector as claimed in claim 8, wherein the second resisting portion has an arched end for resisting against the inner wall of the via of the printed circuit board.

10. An electrical contact terminal, comprising:

a base section defining a principal plane and having an upper side and a lower side;

a contact engaging arm extending from the upper side; and a tail portion extending from the lower side, and extending first away from the principal plane, and then turning back and crossing the principal plane.

11. The electrical contact terminal as claimed in claim 10, wherein a free end of the tail portion comprises a resisting portion including a first curved resisting portion connecting to the lower side of the base section and a second resisting portion extending from a free end of the first resisting portion.

12. The electrical contact terminal as claimed in claim 11, wherein the first resisting portion has a C-shaped configuration, and the second resisting portion extends upwardly and obliquely from the free end of the first resisting portion.

13. The electrical contact terminal as claimed in claim 12, wherein both the first resisting portion and the second resisting portion can respectively resist against an inner wall of a via of a printed circuit board when the tail portion is inserted into the via.

14. The electrical contact terminal as claimed in claim 13, wherein the second resisting portion has an arched end to resist against the inner wall of the via of the printed circuit board.

15. The electrical contact terminal as claimed in claim 14, wherein the upper resilient arm includes a main beam linking with the base section by a curved connecting portion and a beam contact portion extends upwardly and obliquely from the upper end of the main beam.

16. An electrical connector assembly comprising:

an insulative housing defining a plurality of passageways extending therethrough in a vertical direction;

a plurality of contacts disposed in the corresponding passageways, respectively, each of said contacts defining a retention section lying in a vertical plane which is disposed in the corresponding passageway with opposite first and second spaces by two sides of said plane in a transverse direction perpendicular to said vertical plane, a resilient contacting arm upwardly extending from a lower portion of the retention section firstly toward the first space with a segment transversely abutting against an interior face of the housing around said corresponding passageway, and further backwardly extending toward the second space and above a top face of the housing for engagement with an electronic package loaded upon the top face.

17. The electrical connector assembly as claimed in claim 16, wherein said contact further includes another resilient arm extending downward from said lower portion of the retention section firstly toward a space under said first space and successively backwardly toward another space under said second space.

18. The electrical connector assembly as claimed in claim 17, wherein said another resilient arm is essentially fully exposed upon a bottom face of the housing.

19. The electrical connector assembly as claimed in claim 16, further including a printed circuit board located under the bottom face of the housing and defining a plurality of holes in alignment with the corresponding passageways in said vertical direction, respectively, wherein said another resilient arm extends into the corresponding hole and transversely abutting against at least one position of said hole.

20. The electrical connector assembly as claimed in claim 19, wherein said another resilient arm further transversely abuts against another position of the printed circuit board opposite to said position.

* * * * *